US008960788B2

(12) United States Patent
Chuah

(10) Patent No.: US 8,960,788 B2
(45) Date of Patent: Feb. 24, 2015

(54) GROOVE SYSTEM FOR ADJUSTABLE CHAIR

(76) Inventor: Khai Gan Chuah, Austin, TX (US)

( * ) Notice: Subject to any disclaimer, the term of this patent is extended or adjusted under 35 U.S.C. 154(b) by 338 days.

(21) Appl. No.: 13/353,327

(22) Filed: Jan. 19, 2012

(65) Prior Publication Data

US 2013/0069398 A1 Mar. 21, 2013

Related U.S. Application Data

(60) Provisional application No. 61/536,497, filed on Sep. 19, 2011.

(51) Int. Cl.
*A47D 1/00* (2006.01)
*A47C 7/50* (2006.01)

(52) U.S. Cl.
CPC ..... *A47C 7/506* (2013.01); *A47D 1/004* (2013.01); *A47D 1/008* (2013.01)
USPC ..... 297/153; 297/136; 297/151; 297/256.1

(58) Field of Classification Search
USPC ..... 297/135, 136, 148, 151, 152, 153, 297/256.1
See application file for complete search history.

(56) References Cited

U.S. PATENT DOCUMENTS

| | | | | | |
|---|---|---|---|---|---|
| 2,518,425 | A * | 8/1950 | Kahn | 297/338 |
| 2,643,045 | A * | 6/1953 | Renfro | 182/220 |
| 4,109,961 | A * | 8/1978 | Opsvik | 297/338 |
| D362,554 | S * | 9/1995 | Grundner | D6/339 |
| 6,082,814 | A * | 7/2000 | Celestina-Krevh et al. | 297/118 |
| 6,416,124 | B1 * | 7/2002 | Chen et al. | 297/149 |
| D517,336 | S * | 3/2006 | Engelstad | D6/367 |
| D590,608 | S * | 4/2009 | Ebina | D6/339 |
| D614,873 | S * | 5/2010 | Ebina | D6/339 |
| 8,152,239 | B2 * | 4/2012 | Opsvik | 297/256.15 |
| D663,539 | S * | 7/2012 | Chuah | D6/339 |
| 8,240,765 | B2 * | 8/2012 | Kennedy et al. | 297/338 |
| D668,068 | S * | 10/2012 | Chuah | D6/339 |

* cited by examiner

*Primary Examiner* — David R Dunn
*Assistant Examiner* — Timothy J Brindley

(57) ABSTRACT

The invention consists of modification to the groove of the side panels and integration of locking system on seat and foot plates of the adjustable chair for children. The upright panel of the adjustable high chair has grooves with a single or plurality of holes along the top and bottom surfaces of the groove to catch a comparable interlocking device, for locking desired object at various positions. The modification to the groove allows more versatility to adjustment of height, and exchanging the usability of the adjustable chair to other types of fixtures. In addition to the modification, similar groove system is to be added to the outer surface of the side panels to accommodate changing positions of the food tray or grab rail in accordance to the changing positions of the seat plates. This groove system can also be applied to other adjustable chairs.

10 Claims, 14 Drawing Sheets

GROOVE SYSTEM FOR ADJUSTABLE CHAIR

CROSS-REFERENCE TO RELATED APPLICATIONS

This application claims priority to U.S. Provisional Application Ser. No. 61/536,497 filed on Sep. 19, 2011.

BACKGROUND OF THE INVENTION

1. Field of the Invention

This invention relates to modification to the method of adjustment of seat depth and height of chair plates, and the height of food tray and/or grab rail on adjustable chair for children.

2. Discussion of Prior Art

The classic adjustable chair for children described in U.S. Pat. No. 4,109,961 is capable of accommodating children of various ages to adults with different heights by adjusting the height of the seat plate. The patent uses a series smooth-surfaced horizontal groove arranged vertically on inner surface of the uprights (or upright panels) and facing each other. A foot rest plate and a seat plate, both having opposite ends respectively slide in opposite ones of the grooves at desired vertical locations along the upright panels. These chair plates are tightly held in place by tension and friction force between the two upright panels and the plates. The tension created by tightening screws and nuts on the upright panels. This method of adjustment requires significant time and effort requiring significant amount of human strength to ensure tightness of the screws and nuts. Moreover, one or more tools are required to loosen and tightened screws and nuts.

In addition, the series of horizontal grooves only applied to inner upright panels and not on outer upright panels to support the synchronization of the food tray or grab rail with the position of the seat. As a result, a growing child will end up with a food tray at higher position than usual, causing improper seating in the adjustable chair.

SUMMARY OF INVENTION

The present invention relates to an easier method to adjust the chair plates on the adjustable chair. This is accomplished by changing the smoothed-surface groove into a groove of a single hole or plurality of holes. The seat and foot plates are attached with parts of interlocking system that snaps on and off the adjustable chair. By having this type of system, it allows an interlocking system that does not require friction force, or addition tools to secure the plates in place. The chair plate which consists of either seat or foot plate can be removed from the chair, and secured at the desired height on the chair quickly, with no additional tools required. Consequently, the chair can be adjusted from fitting a toddler to adult in a matter of seconds. In addition, to accommodate a growing child, the outer surface upright panels are now added with addition grooves each with different level of precise position according to child body height on sitting posture which allow the food tray or grab rail to switch positions for better comfort as the child grow. The series of grooves on the outer panels is designed to synchronize with the series of grooves on the inner upright panels. This is to avoid an excess gap or opening between the food tray or grab rail and the seat, when the seat position has been adjusted to different level of grooves. For example, if the seat position is lowered one level, the food tray or grab rail on outer position will be adjusted one level lower to ensure proper seat-tray alignment. Without adjusting the outer groove level, an excess vertical gap will appear which may cause the child to slip through the gap underneath the tray easily, causing a safety hazard. Besides creating a safety hazard, the food tray will also be out of a proper alignment for the child. The series of grooves on the outer panels are designed to make sure height of each level is closely coordinated with the groove on the inner panel, with precise measurement, so that distance between the food tray and the seating surface complies with ASTM F404, the American Society for Testing and Materials (ASTM) safety standard for high chair.

The present invention can be applied into any kind of adjustable chair of any shape and size made of wood or artificial materials.

DETAILED DESCRIPTION OF INVENTION

Figure 1:
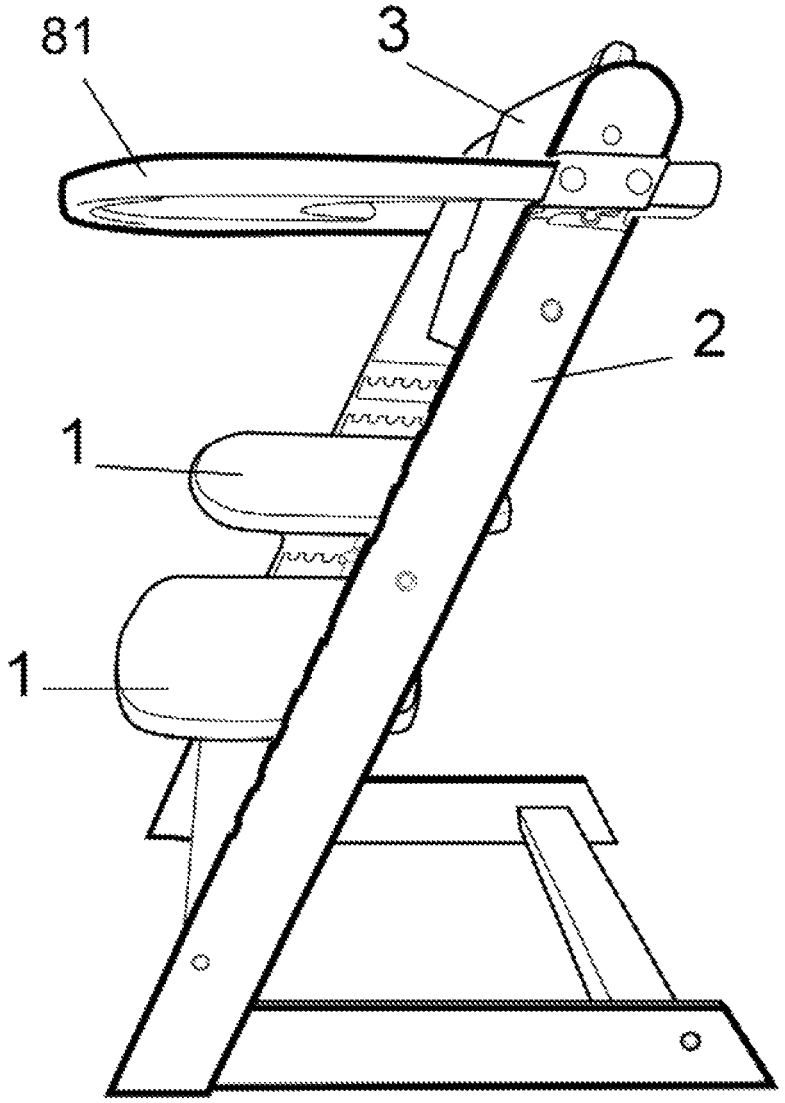
FIG. 1 is a perspective view of the adjustable chair in its entirety showing the different parts of the chair.
Figure 2:
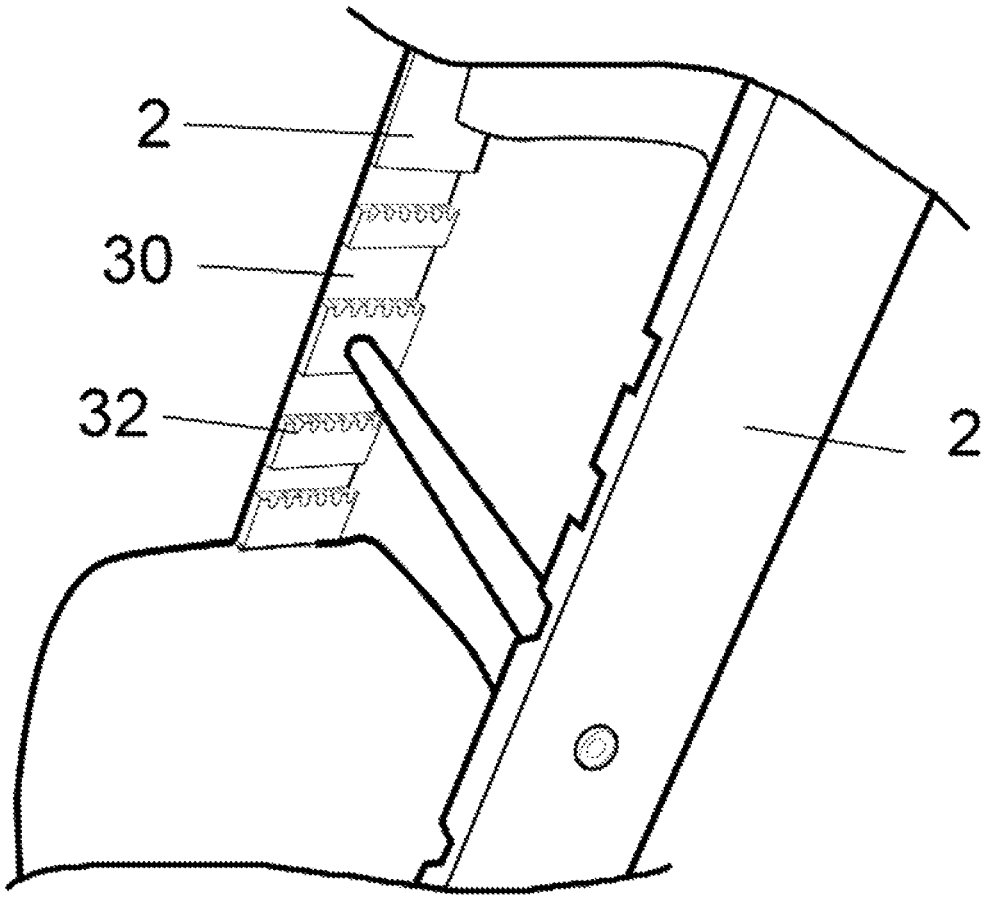
FIG. 2 is partial perspective view of the upright panels, chair plate and lateral view of the grooves.
Figure 3:
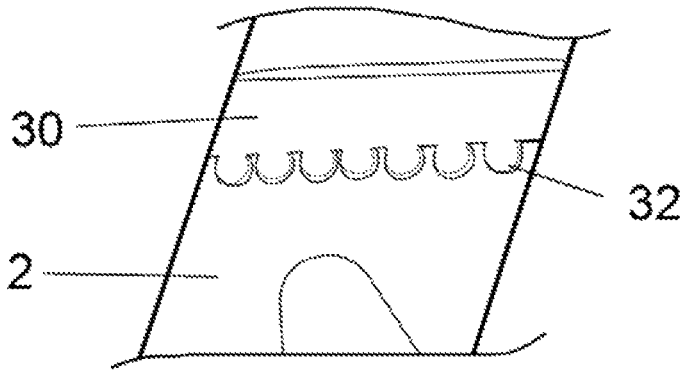
FIG. 3 is a close-up partial lateral view of the upright panel, showing the lower horizontal lip of the groove with a plurality of holes.

The present invention relates to an easier method to adjust the seat depth and height of chair plates, and the height of food tray and/or grab rail on adjustable chair for children. It can be applied on any type of adjustable high chair of various designs, sizes and shapes. The general parts of an adjustable high chair comprises of chair plates 1, of one designed as a seat plate, and another as a foot plate; two upright panels 2 on each sides of the chair, backrest 3 and a food tray or grab rail 81. The invention modifies the method of fastening the said chair plates 1 onto the upright panels 2 by means of an interlocking system that utilizes a plurality of holes 32 or single hole on the grooves 30 aligned on the inner surface of the said upright panels 2. See FIG. 2. These grooves are aligned vertically along the upright panels 2, at the desired height span, equivalently on each facing sides. It is noted, FIG. 3, that even though the plurality of holes or single hole is intended on the lower lip of the groove, the plurality of holes 32 or single hole can also be on the lower and upper lips of the said groove. Advantages of this variation will be discussed in the next paragraph.

Figure 4:
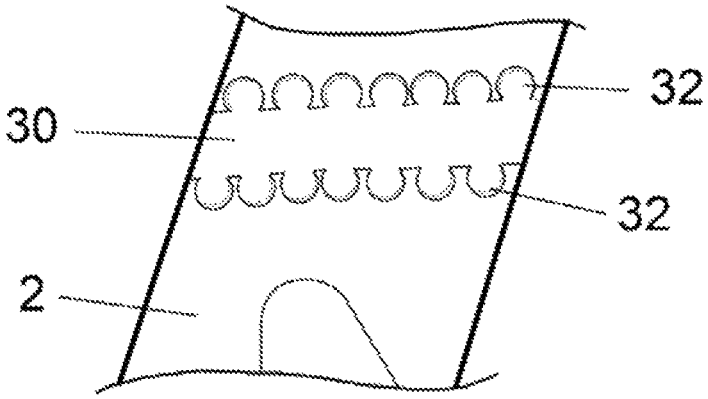
FIG. 4 is a partial lateral view of the inner surface of the upright panel, showing the upper and lower horizontal lips with plurality of holes.

The plurality of holes 32 or single hole allows the chair plate be locked at a variety of positions horizontally, thus adjusting the chair depth in order to accommodate different sizes of the user. The plurality of holes 32, compared to a single hole adds to the stability of the seat. This is because the plurality of holes increases the contact surface between and seat and the upright panel within the interlocking system, thereby minimizing the shakiness of seat. The advantage of having the single or plurality of holes on the upper and bottom (FIG. 4) lips of each groove 30 is that it allows the chair plate to be installed in more than one way. This creates more variety of seat arrangements for different usage. For example, the chair plate of a smooth surface for seating can be flipped to reveal the bottom surface, which happens to be a non-skid surface for use of a stepladder. Or the chair plate that has a child passive restraint system on the front of the plate to prevent a baby from sliding out of the chair can be inverted where the child passive restraint is now at the back, and a smooth surface at the front for adult seating.

It is also noted that the plurality of the holes 32 or single hole can be of various shapes and sizes to fit the accompanied interlocking system on the chair plate 1. The plurality of holes 32 or single hole can be of and not limited to, extension and indention (hills and valleys), holes for tabs, holes with slots for anchoring hook locks. The different sizes and designs will be further discussed in the paragraphs below when alternate embodiments are mentioned.

Figure 5:
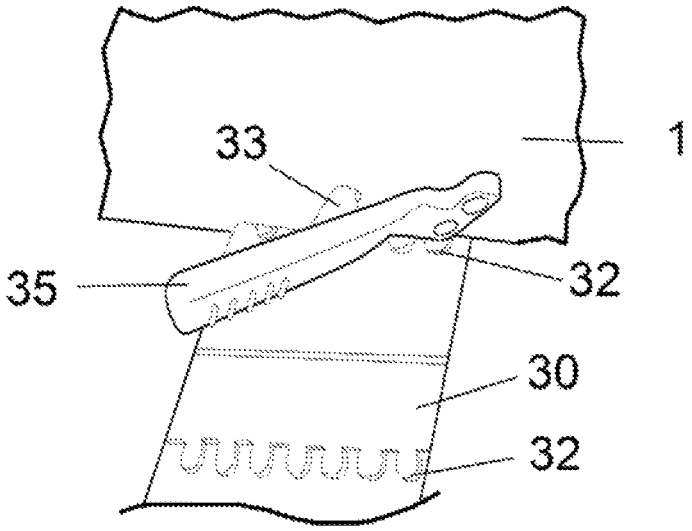
FIG. 5 is a lateral view of the inner surface of the upright panel, showing the interlocking system, whereby the second part of the interlocking system on the chair plate, attaches onto the plurality of holes on the groove.
Figure 6:
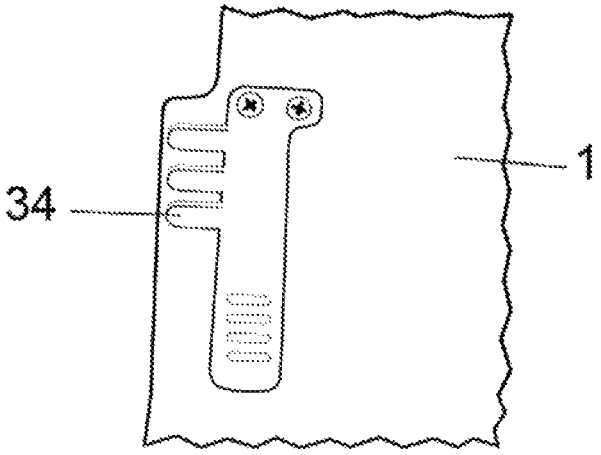
FIG. 6 is a top view of the locking mechanism on the chair plate with a plurality of tabs, instead of a single tab.

The second part of the interlocking system is found on the chair plate depicted FIG. 5. The plate 1 has, on each side, a complimentary strip of a single 33 or a plurality of tabs 34 (shown in FIG. 6) designed to fit optimally onto the plurality of holes 32 or single hole on the groove. The said tab can also be a hook, or, a plurality of hooks.

The engagement of the lock is accomplished by the release of the tension created by a lever 35 that is attached to the tab 33 or plurality of tabs 34 (See FIG. 6) to form a locking mechanism. The said lever 35, when tension applied, depresses the tab/tabs 33/34, allowing the plate 1 to slide along the groove 30. When desired placement is reached, the lever tension is released to allow the tab/tabs 33/34 to engage lock onto the plurality of holes 32 or single hole. It is noted that the locking mechanism can be of various designs, sizes and shapes with the intent to engage tab/tabs 33/34 with the plurality holes 32 on the vertical side of the groove 30. For example, the lever 35 can be replaced by a spring-operated push button.

Alternate Embodiments

Figure 7:
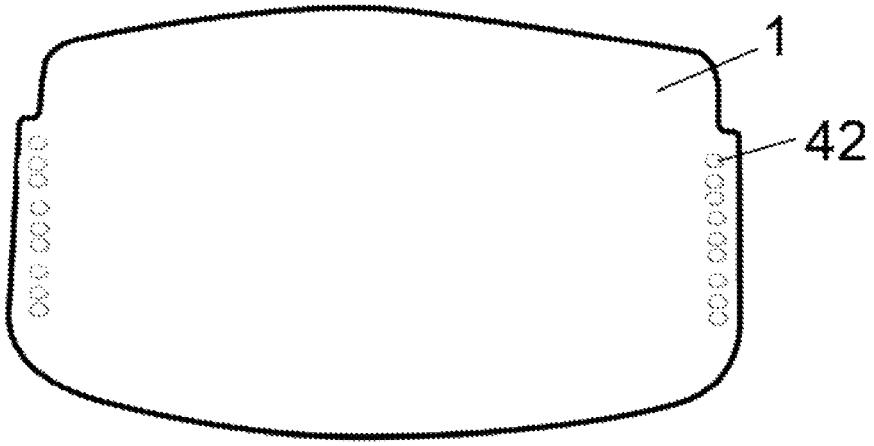
FIG. 7 is a view of a chair plate with a plurality of holes as an alternate embodiment of the invention.
Figure 8:
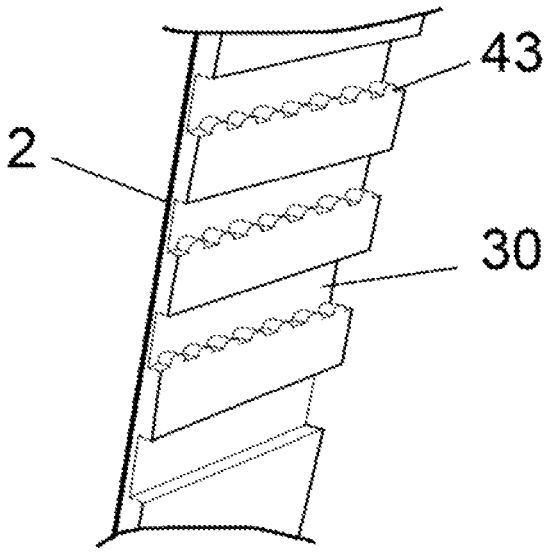
FIG. 8 is a partial perspective view of an example of the alternate embodiment showing pattern of a plurality of tabs, corresponding to the plurality of holes on the chair plate depicted in FIG. 7.

It is to be noted that an alternate embodiment to the intervention is to exchange the positions of the interlocking system parts. Instead of being on the groove, the plurality of holes 42 or single hole is now placed on the chair plate 1. See FIG. 7. Instead of being on the plate, the plurality of tabs 43 or single tab is on each groove along the upright panels 2. See FIG. 8. The said chair plate 1 with single or plurality of holes will be slid into different spots along the plurality of tabs 43 or single tab for adjustments of desired positions, and then be locked in position by way of the interlocking system similar to the primary embodiment.

Figure 9:
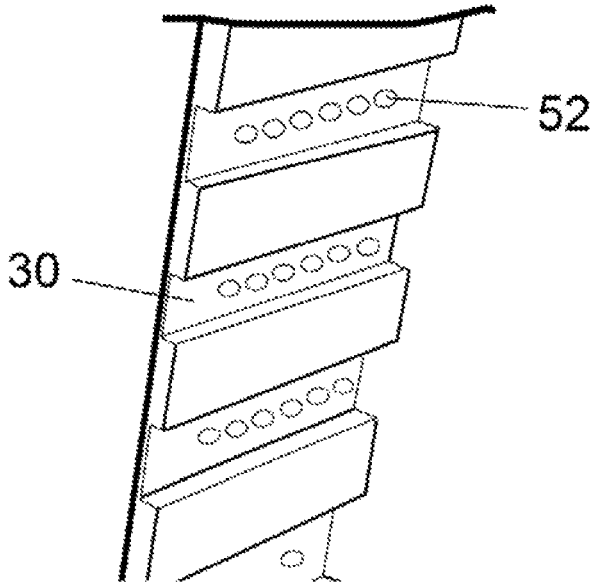
FIG. 9 is a partial perspective view of an alternate embodiment with a plurality of holes on the vertical side of each groove on the upright panel.
Figure 10:
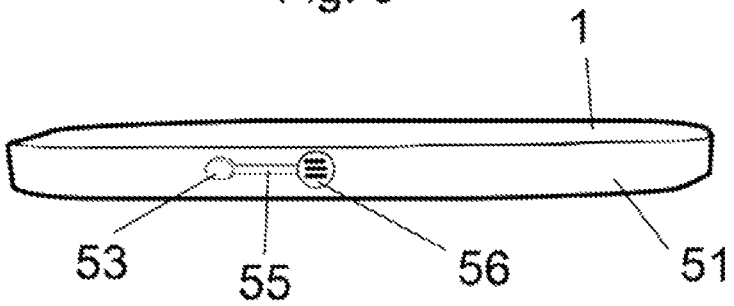
FIG. 10 is a perspective view of the chair plate, with an alternate embodiment of the second part of the interlocking system on the vertical side of the chair plate, corresponding to fit the plurality of holes depicted in FIG. 9.

Another embodiment to the invention is that the plurality of holes 52 or single hole is disposed on the vertical aspect as opposed to the horizontal (upper and bottom lips) of the groove 30 on the upright panels 2. See FIG. 9. In this case, the second part of the interlocking system, shown in FIG. 10, will be on the vertical sides 51 of the chair plate 1 to fit the vertical position of the said plurality of holes 52 or single hole. The tab/tabs 53, now on the vertical sides 51 of the chair plate I will operate similarly with tension created by depression of the lever 55 with or without a button 56, to slide the tab 53 attached to the said lever 55, along the said groove 30 in FIG. 9. When desired position is obtained, the said lever will be released allowing the chair plate 1 to lock in position. It is to be noted that a hook can also be used in replacement of the said tab 53. It is to be noted also that the said tab 53 can be replaced with a plurality tabs to fit the plurality holes 52 on the vertical side of the groove 30. Similarly, the plurality of holes 52 can be replaced with a single hole, to fit a single or plurality of tabs 53. It is also noted that the lever of the locking mechanism can be of various designs, sizes and shapes with the intent to engage tab 53 with the plurality holes 52 on the vertical side of the groove 30. For example, the lever 55 can be replaced by a spring-operated push button.

Figure 11:
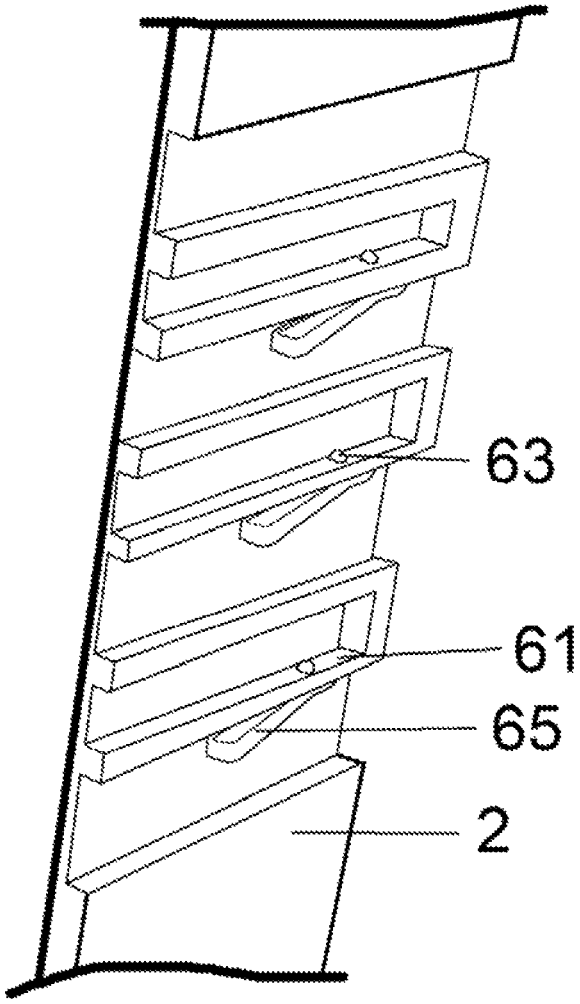
FIG. 11 is a partial perspective view of an alternate embodiment of the locking mechanism on the groove.

Another embodiment to the above described, where the strip of single tab 63 or plurality of tabs are on the upright panels 2. It is noted that the groove on the upright panels is equipped with the locking mechanism 61, as shown in FIG. 11. The locking mechanism 61 is aligned in vertical series on each side of the inner surface of the upright panels 2. The chair plate 1, depicted in FIG. 7, equipped with corresponding plurality of holes 42 or single hole on each side slides along the locking mechanism 61 to engage the lock. The locking mechanism 61 consists of a tension lever 65, much like the initial embodiment of the invention, with a single tab 63 or plurality of tabs to fit the plurality holes 42 or single hole on the said chair plate 1 as in FIG. 7. It is also noted that locking mechanism can be of various designs, sizes and shapes with the intent to engage tab 63 with the plurality holes 42 on the said chair plate 1. For example, the lever 65 can be replaced by a spring-operated push button.

Figure 12:
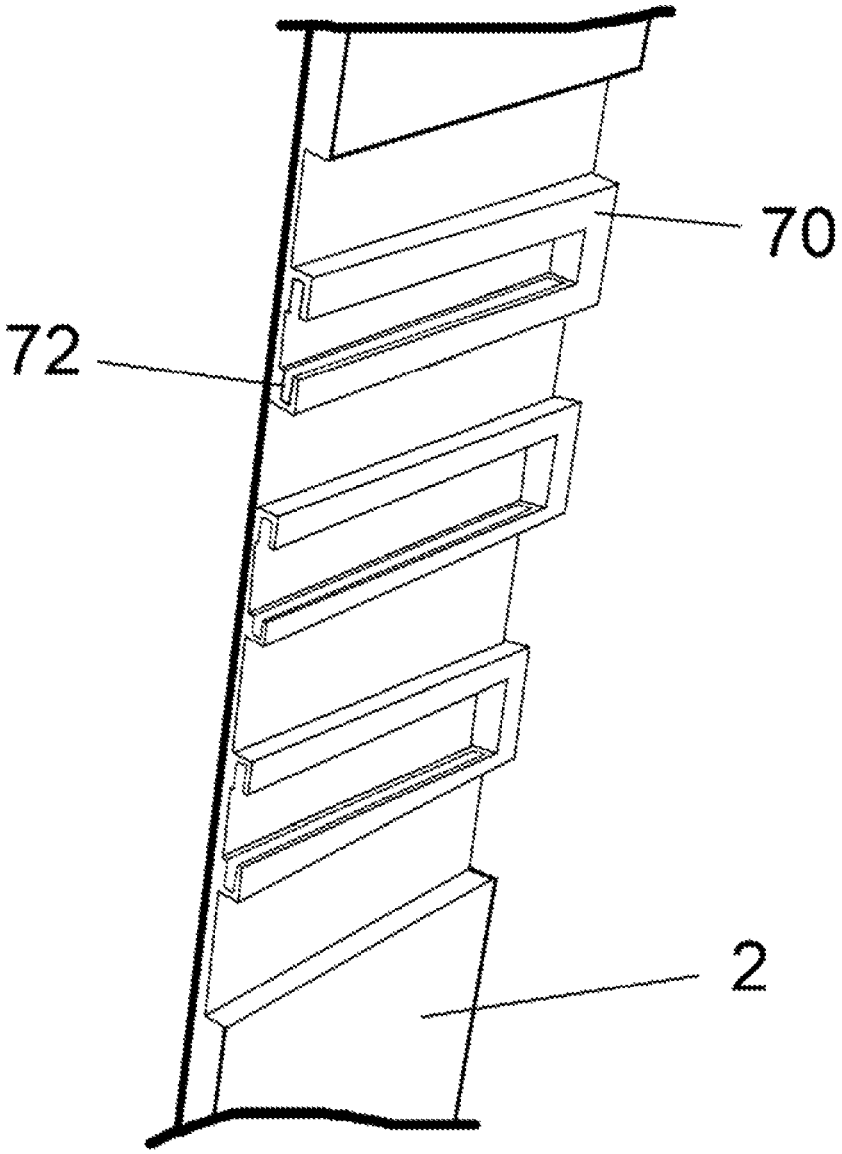
FIG. 12 is a partial perspective view of an alternate embodiment with column of slots along the upright panel.
Figure 13:
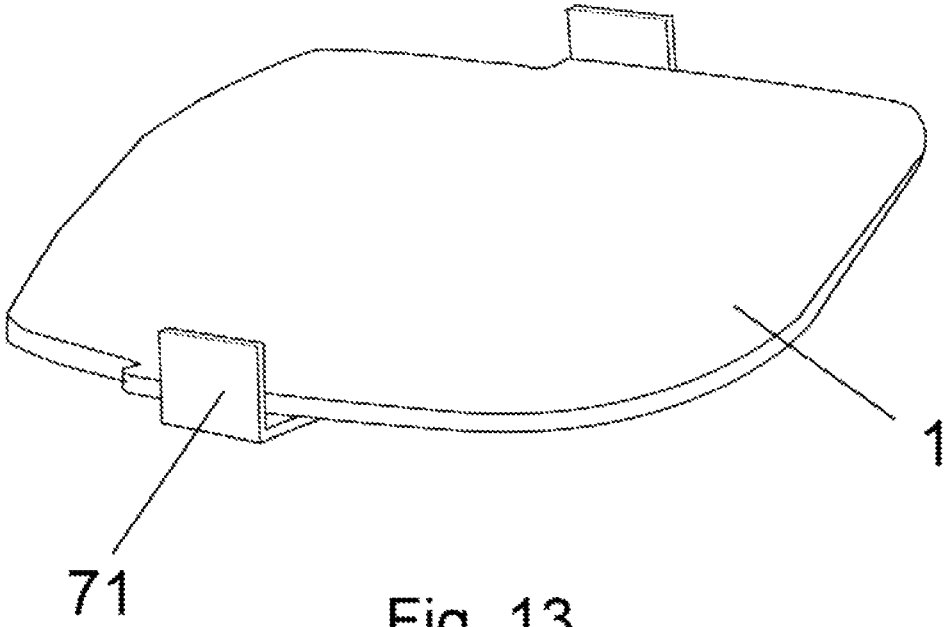
FIG. 13 is a perspective view of an alternate embodiment of the second part of the interlocking system on the chair plate to fit into the slot depicted in FIG. 12.

In FIG. 12, an alternate embodiment to the groove that comprises of a single or plurality of holes as discussed in above sections, the groove is replaced with a column 70 with slots 72 on the upper and/or the lower lips of the said column 70. These columns 70 are arranged in vertical series along the upright panels 2. This said column 70 utilizes a second part of the interlocking system that comprises of a hook mechanism 71 on the chair plate 1 depicted in FIG. 13.

Another embodiment to the invention is a series of grooves are disposed on the outer surface on the said upright panels 2.

The addition grooves on outer surface upright panels 2 allows the installation of a food tray or grab rail on the adjustable chair. Grab rail is a term to describe a bar across a child, used in the absence of a food tray on an adjustable chair. For the purpose of simplicity, the term "food tray" will include "grab rail" throughout the application.

Figures 14A, 14B:
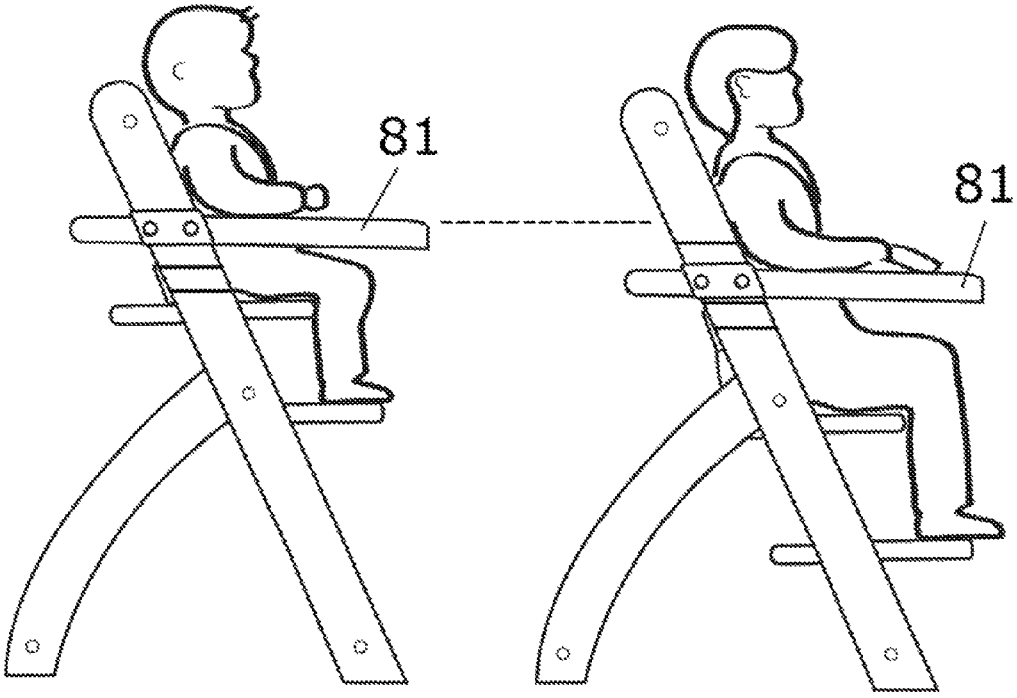
FIG. 14*a* and FIG. 14*b* is a lateral view of the adjustable chair showing the adjustment of the food tray heights.

To accommodate a growing child, adjusting the position of the food tray such as lowering it as the seat plate is lowered is necessary to ensure proper seating alignment of the child at all time. The adjustable chair is modified to having grooves on the outer surface of the said upright panels 2. As depicted in FIG. 14*a* and FIG. 14*b*, a younger child is shown in FIG. 14*a*, to be seated on a seat plate on highest groove level, with the food tray 81 in the proper position. With a older child seated on a seat plate at lower groove level in FIG. 14*b*, the food tray need to be lowered respectively to ensure proper seating for the older child. Otherwise, if the food tray remained in the position similar to the younger child, the food tray would be approximately at the upper chest level of the older child, a position not optimal for normal eating posture.

Figure 15:
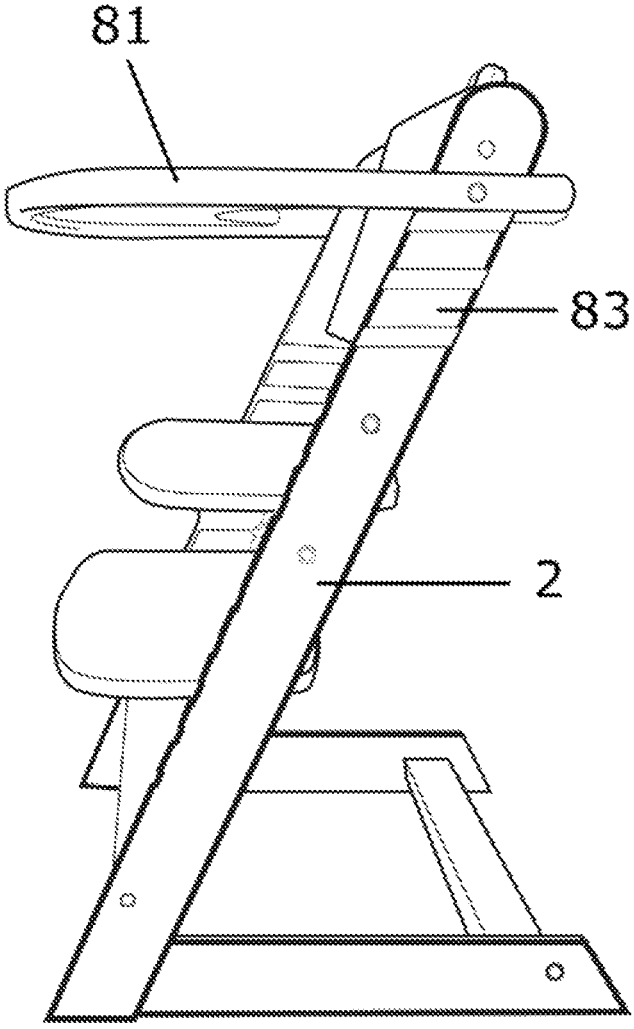
FIG. 15 is a perspective view of the adjustable chair showing a lateral view of the grooves for the food tray.

In FIG. 15, the food tray 81 is places at the highest groove level position on the adjustable chair. A series of grooves 83 is aligned along the outer surface of each upright panels 2. It is to be noted that the distance between each groove along the outer surface of upright panels 2 is determined with respect to the distance of the grooves on the inner surface of said upright panels 2 so that proper seat-tray alignment can be achieved at every height.

Figure 16:
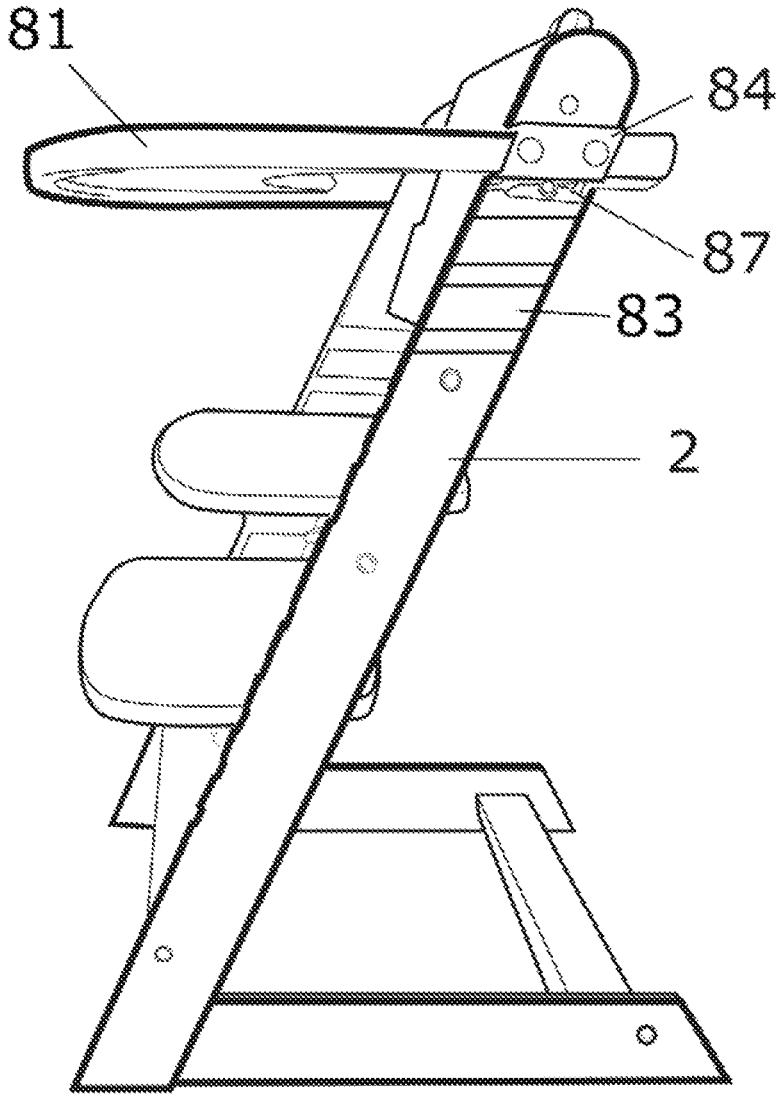
FIG. 16 is a perspective view of the adjustable chair showing a lateral view of an alternate embodiment of the groove to fit a bracket for the food tray.

As an alternate embodiment, the said grooves 83 can be designed to fit a bracket 84 that can be can be attached or detached from one groove to another at different level when adjustment is desired. This is depicted in FIG. 16. The food tray 81 will have a single or a plurality of holes and said bracket 84 will have a single or a plurality of tabs or vice versa, to achieve interlocking and an optional lever tension 87 to depress the tab(s) when the food tray slides into the said bracket 84, and the said lever tension is released to lock the food tray in place. It is also noted that locking mechanism can be of various designs, sizes and shapes with the intent to lock food tray in place. For example, the lever tension 87 can be replaced by a spring operated push button to depress the tab(s) when the food tray slides into the said bracket 84.

Figure 17:
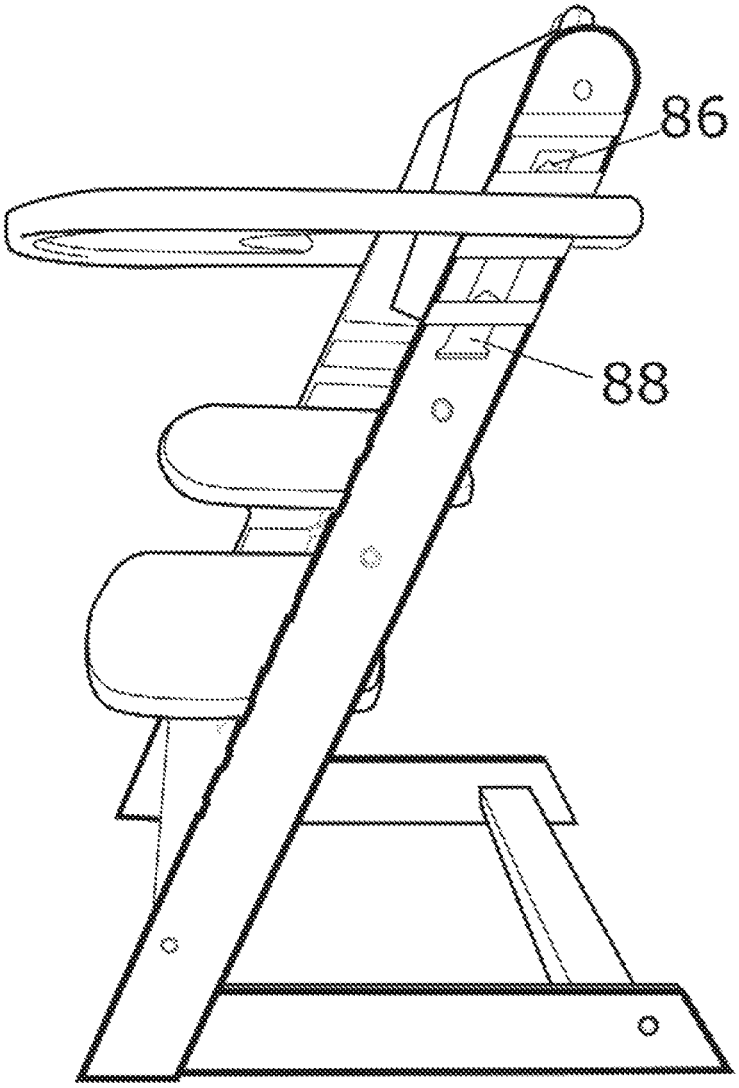
FIG. 17 is a perspective view of the adjustable chair showing a lateral view of an alternate embodiment of the groove with a single or plurality of tabs or similar projection means for interlocking system.

Another alternate embodiment of the groove is to have a single tab 86 or a plurality of tabs on each groove, with a lever tension 88 mounted along tabs connecting the said tabs along the series grooves. The said lever tension 88 depresses and releases the tabs 86 during the position adjustment of the food tray. This embodiment is depicted in FIG. 17. It is to be noted that the said lever tension can be located at other positions, not limited to one, shown in FIG. 17.

Figure 18:
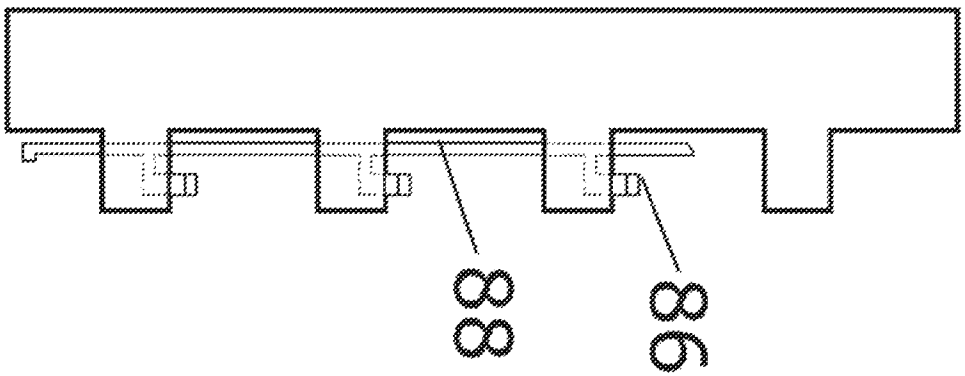
FIG. 18 is a posterior view of the groove said in FIG. 17 showing the level to control the single or plurality tabs on each grooves.

FIG. 18 is the posterior view of the alternate embodiment of the grooves shown in FIG. 17. In FIG. 18, the said lever tension 88 is shown as a long extension connecting the tabs 86 on the grooves. When depressed, the tabs are lowered into the floor of each groove, thereby allowing the food tray to slide into position. Once the desired position is obtained, the lever tension 88 is released and the said tabs will rise to lock the food tray in place. It is also noted the said lever tension 88 can be of various designs, sizes and shapes with the intent to lock the food tray in place.

It is to be noted that this embodiment can be of a separate unit mounted to the outer surfaces of the upright panels 2, as opposed to being carved onto the upright panel. It is to be noted that this unit can be mounted on the inner surfaces of the upright panels as well if indicated or desired. The invention can also be fitted into any type of adjustable chair, regardless of its shape and design, as long as the purpose is to maintain optimum height between the seat and the food tray.

The invention claimed is:

1. An adjustable high chair comprising: at least two upright panels, each upright panel having at least one groove, the at least one groove further comprising at least one hole on the inner surface of each upright panel; at least one chair plate slideably moveable along a horizontal axis within the at least one groove on inner surface of each of the at least two upright panels, the at least one chair plate sliding between a first and second direction within the groove, the at least one chair plate further comprising at least one tab and at least one locking mechanism, the at least one tab configured to move between a first and a second position perpendicular to the at least one groove and to engage with the at least one hole of the at least one groove in the second position, the at least one locking mechanism further including at least one push button, the at least one tab attached to the push button and the push button affecting the vertical movement of the at least one tab from the first position to the second position as a result of pressure applied to the button, the tab being configured to allow the movement of the chair plate in the first and second directions when the tab is in the first position; and at least one backrest coupled between the two upright panels, the hole restricting the movement of the at least one tab and the at least one chair plate in both the first and second directions when the at least one tab is in the second position.

2. The adjustable high chair according to claim 1, wherein the at least one chair plate further includes at least one locking mechanism, the locking mechanism configured to engage contact between the at least one hole and the at least one tab.

3. The adjustable high chair according to claim 1, each groove further including a least one horizontal lip and wherein each of the at least one hole is disposed along the horizontal lip of the groove.

4. The adjustable high chair according to claim 3, wherein each of the at least one hole is disposed along the horizontal lip.

5. The adjustable high chair according to claim 1, the chair further including at least one second groove on the outer surface of each of the at least two upright panels and at least one tray system being connected to at least one groove on the outer surface of each of the at least two upright panels.

6. The adjustable high chair according to claim 5, wherein the at least one groove on the outer surface aligns in a vertical series with the at least one groove along the inner surface of the at least two upright panels.

7. The adjustable high chair according to claim 6, wherein the at least one tray system further comprising: at least one bracket attached to the at least one groove along the outer surface of each of the at least two upright panels; the at least one bracket having a locking mechanism to engage the tray system.

8. The adjustable high chair according to claim 6, wherein the at least one groove further comprises at least one locking mechanism.

9. The adjustable high chair according to claim 1, the high chair further including at least one tray system positioned between the two upright panels to form a food tray table.

10. An adjustable high chair comprising: at least two upright panels, each upright panel having at least one groove, the at least one groove further comprising at least one hole on the inner surface of each upright panel; at least one chair plate slideably moveable along a horizontal axis within the at least one groove on inner surface of each of the at least two upright panels, the at least one chair plate sliding between a first and second direction within the groove, the at least one chair plate further comprising at least one tab and at least one locking mechanism, the at least one tab configured to move between a first and a second position perpendicular to the to the at least one groove and to engage with the at least one hole of the at least one groove in the second position, the hole restricting the movement of the at least one tab and the at least one chair plate in both the first and second directions when the at least one tab is in the second position, the at least one locking mechanism further including at least one push button, the at least one tab attached to the button and the button affecting the vertical movement of the at least one tab from the first position to the second position as a result of pressure applied to the button, the tab being configured to allow the movement of the chair plate in the first and second directions when the tab is in the first position.

* * * * *